US006250360B1

(12) United States Patent
Ochoa

(10) Patent No.: US 6,250,360 B1
(45) Date of Patent: Jun. 26, 2001

(54) OVERHEAD DOOR SUPPORT STRUCTURE AND OPERATOR SUPPORT MEMBERS

(75) Inventor: Carlos M. Ochoa, College Station, TX (US)

(73) Assignee: ICOM Engineering Incorporated, Dallas, TX (US)

( * ) Notice: Subject to any disclaimer, the term of this patent is extended or adjusted under 35 U.S.C. 154(b) by 0 days.

(21) Appl. No.: 09/386,097

(22) Filed: Aug. 30, 1999

Related U.S. Application Data

(63) Continuation-in-part of application No. 09/116,689, filed on Jul. 16, 1998, now Pat. No. 5,954,111, which is a continuation-in-part of application No. 08/787,472, filed on Jan. 22, 1997, now abandoned.

(51) Int. Cl.[7] ..... E05D 15/06
(52) U.S. Cl. ..... 160/201; 16/96 R
(58) Field of Search ..... 160/201, 178.1 R, 160/133, 188; 16/96 R, 87 R, 94 R

(56) References Cited

U.S. PATENT DOCUMENTS

| | | | | |
|---|---|---|---|---|
| 2,251,967 | * | 8/1941 | Yoder . | |
| 2,287,372 | | 6/1942 | Blodgett . | |
| 2,534,641 | * | 12/1950 | Veigel . | |
| 2,686,926 | | 8/1954 | Schacht, Jr. . | |
| 2,702,082 | | 2/1955 | Wolf . | |
| 2,923,541 | * | 2/1960 | Gessell . | |
| 2,925,267 | | 2/1960 | Volf . | |
| 2,991,496 | | 7/1961 | Wolf . | |
| 3,511,301 | | 5/1970 | Graham et al. . | |
| 3,608,613 | | 9/1971 | Halliwell | 160/201 |
| 3,797,171 | | 3/1974 | Farmer . | |
| 4,119,133 | | 10/1978 | Wolf . | |
| 4,966,217 | * | 10/1990 | Dechambeau et al. . | |
| 5,172,744 | | 12/1992 | Finch et al. | 160/201 |
| 5,222,403 | * | 6/1993 | Angelini et al. | 160/188 |
| 5,408,724 | | 4/1995 | Mullet et al. . | |
| 5,533,561 | * | 7/1996 | Forehand, IV | 160/188 |
| 5,630,459 | | 5/1997 | Martin | 160/201 |
| 5,954,111 | * | 9/1999 | Ochoa . | |

* cited by examiner

*Primary Examiner*—Blair M. Johnson
(74) *Attorney, Agent, or Firm*—Browning Bushma

(57) ABSTRACT

A track support structure (30) for a sectional overhead garage door (10) having rollers (16) for guiding the door (10) between open and closed positions. The track support structure (30) has a track (38) and a track support beam (40). Track (38) has an upper horizontal flange (38) and a lower trough (72). The free edge of the trough (72) has an inturned tubular bead (74) and the free edge of upper flange (38) has an inturned tubular bead (74). An angle-shaped track support beam (40) has legs (88) and (90). The free edges of legs (88) and (90) have respective tubular beads (92) and (94). Tubular beads (92), (94) have a diameter between 1½ and 2½ times the diameter of beads (74), (76) on track (38). Embodiments shown in FIGS. 8–10 include an automatic door operator (104) having a channel-shaped support beam (110, 110A) with tubular beads (116, 116A) on laterally extending flanges (112, 112A, 114, 114A).

12 Claims, 4 Drawing Sheets

FIG. 1
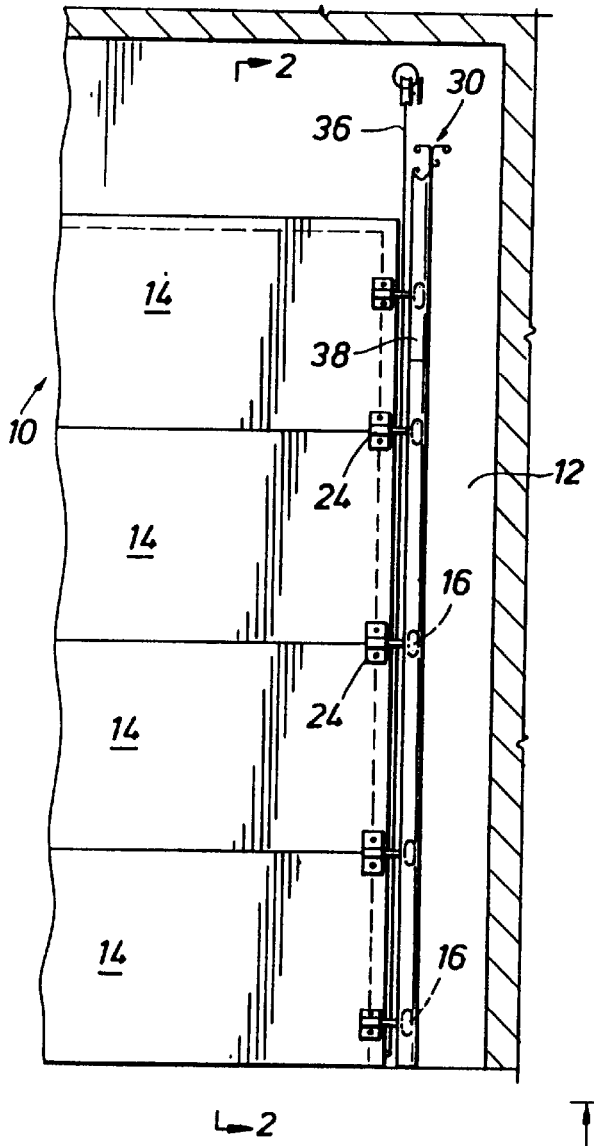
FIG. 5
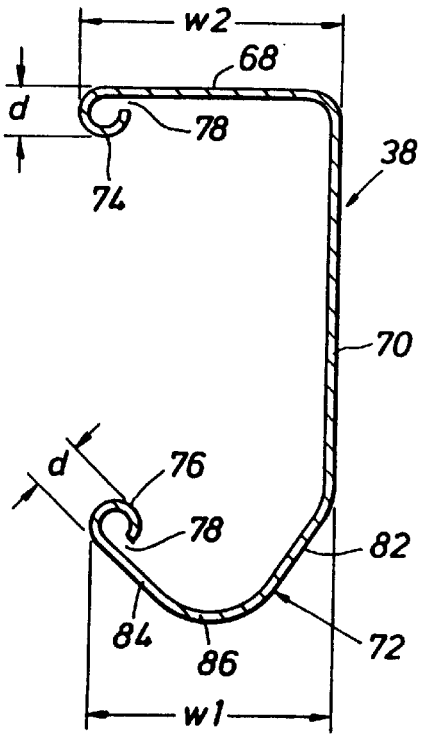
FIG. 6
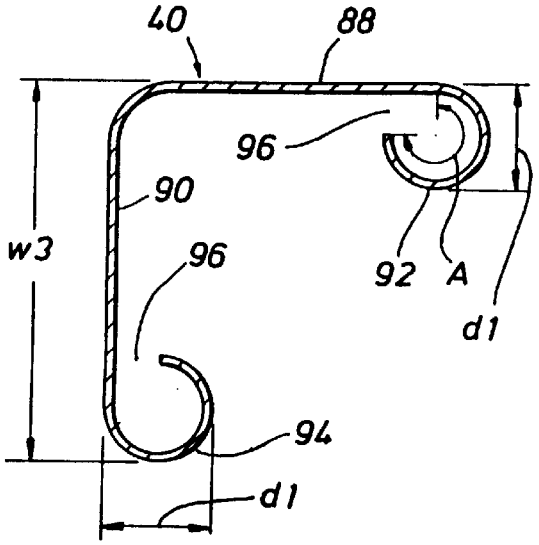
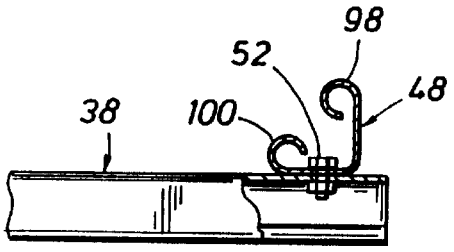
FIG. 7

10
12
14
16
18
20
22
24
26
27
28
30
32
34
36
38
40
42
44
46
48
50
54
58
66
68
70
72
74
76
82
84
86
88
90
92
94

OVERHEAD DOOR SUPPORT STRUCTURE AND OPERATOR SUPPORT MEMBERS

REFERENCE TO RELATED APPLICATION

This application is a continuation-in-part of application Ser. No. 09/116,689 filed Jul. 16, 1998; now U.S. Pat. No. 5,954,111 which is a continuation-in-part of application Ser. No. 08/787,472 filed Jan. 22, 1997 now abandoned.

FIELD OF THE INVENTION

This invention relates generally to a support structure for a hinged sectional overhead door, and more particularly to a track structure with angle support members for guiding and supporting rollers on the door for movement of the door between open and closed positions.

BACKGROUND OF THE INVENTION

Conventional track structures with angle support members are used for guiding and supporting rollers on sectional overhead doors such as garage door systems. The angle support members work in conjunction with the track to provide strengthening and resistance to deflection. Typically, a horizontal support member is attached along the horizontal lengthwise direction to the horizontal track. In this position it serves to attach the track to the jamb of the door opening, as well as to provide support against lateral deflection of the horizontal track. Another angle support member is attached at the extreme end of the horizontal track where it serves as a vertical hanger to attach the track to the building structure. Both track and support angles pose several problems, particularly when a relatively small thickness or cross sectional area of metal material is utilized in some or all of these parts of the track structure. These problems include (1) the tendency of the track and horizontal support angle to "bow", i.e. deflect in a horizontal direction toward the middle of the door, when significant weight is applied to the track through the door rollers, (2) the tendency of the track and horizontal support angle to bend or deflect downward in a vertical plane over large unsupported spans, (3) the tendency of the track trough to deform near the roller including widening of the trough and possible crimping of the edges due to the heavy weight of the door, or due to roller misalignment, and (4) damage to the exposed blade edges of the track structure during manufacture, shipping/handling and installation. Each one of these problems is discussed in sequence below.

Track and horizontal support angle bowing is caused by the way the door roller interacts with the conventional track and horizontal angle support system. This problem can lead to a condition known throughout the industry as "roll-out". This is when the door roller literally rolls out of the track trough. This condition can cause failure of the door to open or close properly, or even worse, cause the door to fall out of the track.

The second problem is that too much downward deflection of the track and horizontal support angle causes the supporting hardware on the rollers to drag on the track, resulting in a door not opening or closing smoothly.

The third problem is specifically related to a deficiency in the conventional track trough geometry itself. The conventional track configuration typically has an outer blade edge on the track that tends to have weak points wherever any imperfections exists. These points become stress concentration points or focal points where failure may occur due to heavy loads applied through the rollers.

The fourth problem is directly related to the third problem in that even minor damage sustained during shipping and handling, especially to the blade edge of the track can easily cause weak points in the track edge as set forth above.

There have been several approaches within the industry to try and address the above problems. Virtually all approaches have included increasing horizontal support angle and/or track depth, thickness, or both. While these approaches are simple, they have resulted in substantially heavier and thus more costly track systems. In contrast, the present novel track system uses a substantially different set of principles to address the above problems, without resorting to the use of a heavier, and thus more costly system.

The novelty and uniqueness of the present invention is that it maximizes the use of material through configuration synergisms, i.e. features that interact and play multiple roles simultaneously, such as contributing substantially to the moment of inertia about the vertical and horizontal axes, while also greatly increasing the resistance of the configuration to local damage and stress concentrations. The result is a dramatic increase in overall performance and efficiency that overcomes the problems set forth. The synergisms are so significant that the combined system achieves unexpected levels of material savings.

In order to better understand the novelty and uniqueness of the present invention, and to more fully appreciate how conventional track made of thinner materials fails in addressing the above four problems, and more specifically problems three and four, it is important to understand failure initiation and propagation in a conventional track system. This is discussed in more detail as follows.

In a conventional track, failure may be generally associated with two fundamental regions of high stress. The first region is associated with failure initiation, and the second is associated with failure propagation. The first region is an inherently characteristic region of edge stress concentration at the "blade edge" of the trough nearest to the roller contact point. This edge stress concentration is characteristic of the overall cross-sectional geometry of the "trough" of the track in which the roller rides. The second region is located in an area between the point of roller contact and the blade edge of the trough. In most commonly found sectional overhead door track sizes, this region is approximately one inch wide. This region is characterized by two stress peaks separated by a short distance along the line of roller travel. In most commonly found overhead door track sizes and weights, these two points are separated by approximately three-fourths of an inch, with one peak located symmetrically on either side of the point of roller contact.

Even the most perfect, smooth trough edge of conventional track will experience a very localized point of high stress gradient due to the characteristic edge stress concentration. Initiation of an edge "bulge" or "crimp" on a perfect smooth edge is nothing more than the creation of an edge imperfection that is large enough to grow or "propagate" easily. It is significant that this stress concentration may be made worse by the presence of any relatively small local imperfections, even those on the order of size of the thickness of the track itself.

Thus, the existence of any edge imperfections in a conventional track have the effect of enhancing an already established process of failure initiation. These imperfections near the edge can be in the form of edge notches, waviness (in-plane or out-of-plane), local thickness variations, local residual stress variations, or variations in material yield strength. Where multiple imperfections occur together, they may all compound together to further increase the stress concentration effect, and thus lower the roller load level at which failure initiates. This is the established process.

In a conventional overhead door track, failure propagation follows failure initiation in the following manner. Once a local "bulge" initiates at the blade edge, in the direction away from the roller contact point, the existence of the second region of high stress enables crimping of the blade edge to propagate. The result is a triangular "tea pot spout" shape which is formed as the edge folds distinctly along two lines connecting the first region of high stress of the blade edge with each of the two peaks of the second region. This propagation can be described as a local "edge buckling" since it is an instability of the metal sheet at the edge.

It should be noted that the propagation process described here corresponds to the case of a roller that is not rolling, but stays in the same position on the track as the load is increased until failure is reached. Actual in-service failures which may involve moving rollers will display variations of this basic propagation mechanism.

Next, consider the support angles. If the conventional L-shaped angles are made significantly thinner, the result will be a blade edge that is sharp to handle during manufacture and installation, and is susceptible to damage during transport. An additional effect will be a significant reduction in resistance to torsional loads (e.g. due to the twisting caused by roller loads).

Consequently there is a demand in the sectional overhead door industry including both garage doors and vehicle doors for a cost effective, retrofitable track system made of thinner material that simultaneously addresses the four problems stated above in addition to resisting the failure sequence noted, while yet maintaining a high degree of manufacturability.

SUMMARY OF THE INVENTION

The tracks and angle support members of the present invention for sectional overhead doors are uniquely configured to achieve synergisms that simultaneously improve structural reliability and performance. They also substantially reduce the weight of these structural members, while preserving functionality and ease of assembly and installation that allows the present system to be retrofitable to most conventional sectional overhead doors. The tracks and angle support members further permit the problem of roller rollout to be addressed without resorting to thicker gauge materials. Not only is an improved means of roller retention provided by the unique configuration, but the track edges themselves are strengthened, thus resisting distortion or warping of the overall track shape that may be associated with roller rollout.

Still further, the combination of curled edge flanges of the tracks and angle support members are uniquely configured so that the combined track and angle support member system maximizes the structural utility and efficiency of the system in a compounding fashion, thus increasing further the door weight that may be carried. This effect is so pronounced that even the use of the new angle support members in combination with conventional track will result in substantial weight savings on those individual members. This unique feature is important from a commercial standpoint in being able to introduce the overall system in a gradual manner, or to introduce only part of the system where prior customer specifications on the track do not provide the flexibility to permit implementation of the entire system simultaneously.

An example of the weight savings where only the horizontal angle member is replaced in an otherwise conventional 2 inch deep residential track system is as follows. If the 1.5×1.5 inch horizontal angle that is typically 0.074 minimum inches (14 gage) thick is replaced by the present invention, then the thickness of material that would be used would be 0.034 minimum inches thick (20 gage) for a weight savings of about 30%. In this case the standard length of the conventional horizontal angle would be the same as for the new horizontal angle. For example, a 22 inch long conventional horizontal angle would be replaced by a 22 inch long new horizontal angle. In a similar fashion, an 82 inch long conventional horizontal angle would be replaced by an 82 inch long new horizontal angle. The preservation of this similarity between conventional and new horizontal angles is an important synergism for maintaining clarity in replacing conventional members with new ones, and specifically in minimizing confusion for installers.

The simplicity of the new angle member shape preserves the manufacturing simplicity and economy traditionally associated with these members. This is also true for the perforated angle support members, whether they are used as vertical hangers, as brace members, or in other aspects of adapting a particular track to a particular building or vehicle installation. An example of this is the installation of automatic door openers, where the opener activation mechanism typically must be supported in a line that runs from the motor which is typically hung from the ceiling of the building or vehicle to the top middle of the door in a path that is typically roughly perpendicular to the plan of the door opening. In some cases it is desired to enclose the drive mechanism whether it be a chain, belt or worm gear. This is because of safety as well as cleanliness for the exposed moving chain, belt, or worm gear. In these cases it is possible to use a modified angle shape such as a channel, with similar weight savings as for the horizontal support angle. An example of this would be a 9 ft. long conventional channel section that would measure 2½ inches across, and 1 inch high and is made of 0.086 inch thick minimum (13 gage) material. The channel section has the same general shape to accommodate the drive chain, belt, or gear. It also has edge features on the channel edges that conform to the optimum ratios of leg length to curl diameter in the vertical plane, since deflection in the vertical plane is of greatest importance. The thickness of the new member is 0.051 inches minimum (17 gage) with ⅜ inch diameter edge curls, and the weight savings on this member is about 30%. Attachment of this member to the motor housing at one end and to the header above the door opening at the other end is accomplished in the conventional manner, typically with perforated angle that includes sway bracing. Yet another automatic door opener drive support member variation that is commonly found in commercial installations such as those that utilize chain drives is a T-shaped channel where the opening of the channel is upward and the channel edge flanges spread outward to form the top of the T. The T-shaped channel is designed to have edge curls on the blade edges of this member that conform to the range of optimum ratios set forth, with a weight savings of about 30%. The typical conventional T channel might be 1½ inches deep and be made from 0.086 inch thick minimum (13 gage) material. The T channel for this particular example would be 0.038 inches thick minimum (19 gage) and about 2 inches deep.

Moreover, all of these important synergisms are achieved while enhancing the functionality of the individual members as well as the assembly. When the entire system is converted over from conventional to the members of the present invention the effect is as follows. The magnitude of the weight saving effect upon structural weight of the assembly including horizontal and vertical tracks as well as the horizontal and perforated angle support members is approximately a 35% weight saving for a typical 350 lbs., two car overhead door installation using an 82 inch long horizontal angle support member, and about a 25% weight saving for a typical 120 lb. single car overhead door installation where the horizontal track is typically used with only a 22 inch long horizontal angle support member.

The fact that the tracks and angle support members with compounding synergisms are suitable for use with substantially all standard sectional overhead door hardware installations enables manufacturers and installers to significantly reduce the number of different track thicknesses and horizontal angle support member lengths that they must carry in their inventories by suitably matching track and angle support members. Furthermore, the track itself is bendable to achieve the transition between horizontal and vertical track using conventional stretch forming machinery. During this forming process the configuration further stabilizes the section, thus improving formability and reducing the influence of edge defects during processing. Finally, and no less significantly, the lighter track and angle support members and assemblies are easier to handle and position during manufacturing, packaging, and installation into buildings or vehicles.

The present invention alleviates and overcomes the above mentioned problems and shortcomings of the present state of the art through the discovery of a novel track system. The invention provides a novel track system for guiding and supporting rollers of an overhead sectional door for movement of the door between open and closed positions. The track system includes a track for guiding and supporting the rollers, and angle support members for supporting the track.

The track and track support members have substantially redistributed material at critical locations as compared with conventional track systems. This material redistribution has the effect of altering considerably the behavior of the track system as compared with conventional track systems. The material redistribution is accomplished by having free edge portions which are turned inwardly to define tubular beads or curls along the free edges. These upper and lower edge curls help the track and angle support member sections to more effectively resist bending and torsion due to roller loads. A substantial synergism occurs as a result of the combined placement of the curl relative to the centroid of the system, and the ability of the curl to spread stresses, since it is placed in positions associated with maximum structural stresses. Moreover, the curls serve to enhance roller retention.

Each tubular bead has a cross-sectional dimension which is large enough to substantially change the moment of inertia of the overall section about the horizontal and vertical axes, as well as to alter the characteristic failure mode normally associated with the free edge stress concentration for a conventional overhead door support structure. This synergism permits the use of thinner materials. This discovery allows a saving in material, while effectively addressing the four problems set forth above, thereby saving weight. This innovation in system configuration represents a substantial cost saving for the track and angle support members, since material cost is a substantial portion of total manufacturing costs for overhead door hardware.

More particularly, the upper and lower edge curls or shapes are tubular features, preferably open-section, that are made by shaping the free edges or edge marginal portions of overhead door track or attached angle member cross-sections into an elliptical, preferably circular, cross-sectional shape. For the purpose of the present application, a circular cross-section is considered to be a special case of an elliptical cross-section. The term "characteristic diameter" referring to a constant diameter in the case of a circle, while other elliptical shapes will have major and minor diameters, with the major diameter being the "characteristic diameter". Even though some configurations of a slightly non-circular elliptical shape may be more desirable in some applications, the circular cross-section is generally preferable, because it is simpler to manufacture, while still achieving the desired benefits to a significant degree.

For manufacturing ease, the tubular bead is preferably an open-section bead, meaning that the sheet metal is formed in an almost complete bend or curl, but the curl need not be closed at its outer edge, such as by welding. A closed section tubular bead would work equally well, at a slightly higher manufacturing cost. The manufacturing method for creating the edge curl geometry is consistent with conventional roll forming. It was discovered that the configuration of the edge features actually served to further stabilize the section during the stretch forming process, thus improving formability. An additional benefit is that the edge curl placement is configured to accommodate slight dimensional width variations or imperfections in raw sheet metal stock that are on the order of 1/32 inch or less. This is important for the following reasons:

1. The edge curl permits a reduction in required manufacturing operations. These operations including deburring and smoothing of the edges as well as monitoring the sheet roll stock for width uniformity and edge quality. The edge curl thus simplifies achieving a product that will have edge dimensional uniformity.
2. The overall structural strength and integrity implications of addressing sheet stock edge imperfections to achieve manufacturing or safety improvements. These improvements must be accomplished at little or no expense to structural performance.

The repositioning of material in the form of a curl has the effect of making the edge insensitive to imperfections that are of the same order of size as the thickness of the sheet. This is characteristic of the "open section tube" geometry and the way that it spreads stresses, even in the presence of local imperfections. The modified edge, including the edge curl, is thus only sensitive to imperfections that are of the same order of size as the curl diameter itself. This is a substantial change in that larger imperfections are not only less common and thus fewer in number, but are also much easier to detect visually. The ability to detect the kinds of imperfections that lead to failure is of fundamental importance to product reliability, maintenance and safety concerns. The result is a substantially safer and more failure resistant product.

Finally, the curl geometry places sheet stock edge imperfections, such as in-plane or out-of-plane waviness or edge notches, in a relatively benign location. This location corresponds to the portion of the curl section geometry nearest to the roller contact surface, where it experiences relatively lower stresses as compared to the region farthest away from the roller contact surface. Thus, the curl permits some imperfections to remain without reducing structural performance, while achieving substantial positive impacts in other important product areas such as safety, reliability, maintenance, manufacturing and handling.

The curl geometry has the effect of spreading stresses out in the region of the edge near the point of roller contact on the track. This is important from three standpoints. The first is that the maximum stress is substantially reduced, thus increasing the load carrying capability of the same thickness track. The second is that the mechanism that existed for the first and second regions of high stress to link up and thus propagate, has been substantially eliminated by spreading out the peak stresses of the region affected. This has the effect of inducing a much greater resistance to failure. This is because the stresses of the high stress region of conventional track are now spread over a region that is larger than the commonly found ¾ inch characteristic dimension.

It is important to contrast the edge curl approach against other possible edge treatment approaches by noting that the dimensional order of size effect described above for the curl can not be achieved by simply folding the edge over, either once or multiple times, because in this case the characteristic dimension will be defined by the fold edge diameter and not by the length of overlap of the fold. This is because the overlap direction is transverse to the edge and quickly moves out of the peak stress region, and because in this case the edge fold diameter defines the maximum distance over which the edge stresses may be effectively spread.

The elliptical or circular open-section tubular shape or "edge curl" is contrasted to tubular sections of rectangular cross-sectional shapes, including folded edges, and to open-section tubular shapes of softened corner rectangular cross-sectional shapes in that the characteristic diameter will be defined in each of these other cases by the fold diameter or by the softened corner diameter nearest to the track edge, as opposed to the overall diameter of the edge curl section. It may be noted that in this context a rectangular cross-section with very softened corners is in effect an imperfect ellipse or circle. In some instances, quasi-elliptical or quasi-circular cross sections, imperfect ellipses, and imperfect circles, in the form of rectangular cross-sections with very softened corners may function adequately, but will be less effective than a generally circular curl.

The resulting design is more robust in that track edge crimping occurs only at much higher loads. It is also more robust because the size of the minimum imperfection to which the edge is sensitive has been generally changed from the thickness dimension to about the size of the curl diameter. This favorable synergistic combination of resistance to crimping and relative insensitivity to edge imperfections has the same degree of compounding advantage as the conventional track's compounding disadvantage of low resistance to crimping combined with sensitivity to relatively small edge imperfections.

The contoured lower section of the track minimizes the moment arm of applied roller loads with respect to the geometric plane of the vertical edge of the track, while maintaining required clearances for smooth operation of the roller. In addition, as a local track section deflects slightly under load, the lower section shape actually deforms in a way that diminishes the moment arm, thereby improving performance.

The invention enables the track gauge thickness to be reduced by an amount up to about 35%. This enables a weight saving of up to about 27% for the track in a typical overhead door application while preserving normal operational and structural capability. In addition, the track is retrofitable to conventional overhead door hardware.

When the edge curl feature is applied to the angle support member attached to the overhead door horizontal track, an additional increment of weight saving on the angle support member is achievable. When this increment is combined with the weight saving achieved with the track, a total weight saving of up to about 35% may be achieved while preserving normal operational and structural capability. The magnitude of this weight reduction was unexpected.

The following description of a preferred embodiment of the present invention may incorporate dimensions which are representative of the dimensions which will be appropriate for most commonly found overhead door sizes. Recitation of these dimensions is not intended to be limiting, except to the extent that the dimensions reflect relative ratios between the sizes of various elements of the invention, as will be explained where appropriate.

BRIEF DESCRIPTION OF THE DRAWINGS

FIG. 1 is a front elevation of a portion of a hinged sectional overhead garage door having rollers mounted in the track structure of the present invention for movement of the door between open and closed positions;

FIG. 5 is an enlarged cross section of the track shown in FIGS. 1–4;

FIG. 6 is an enlarged cross section of the track support member shown in FIGS. 1–4;

FIG. 7 is a cross sectional view of the hanger taken generally along line 7—7 of FIG. 2 for supporting the outer end of the upper horizontal track;

DESCRIPTION OF THE INVENTION

Figures 2, 4:
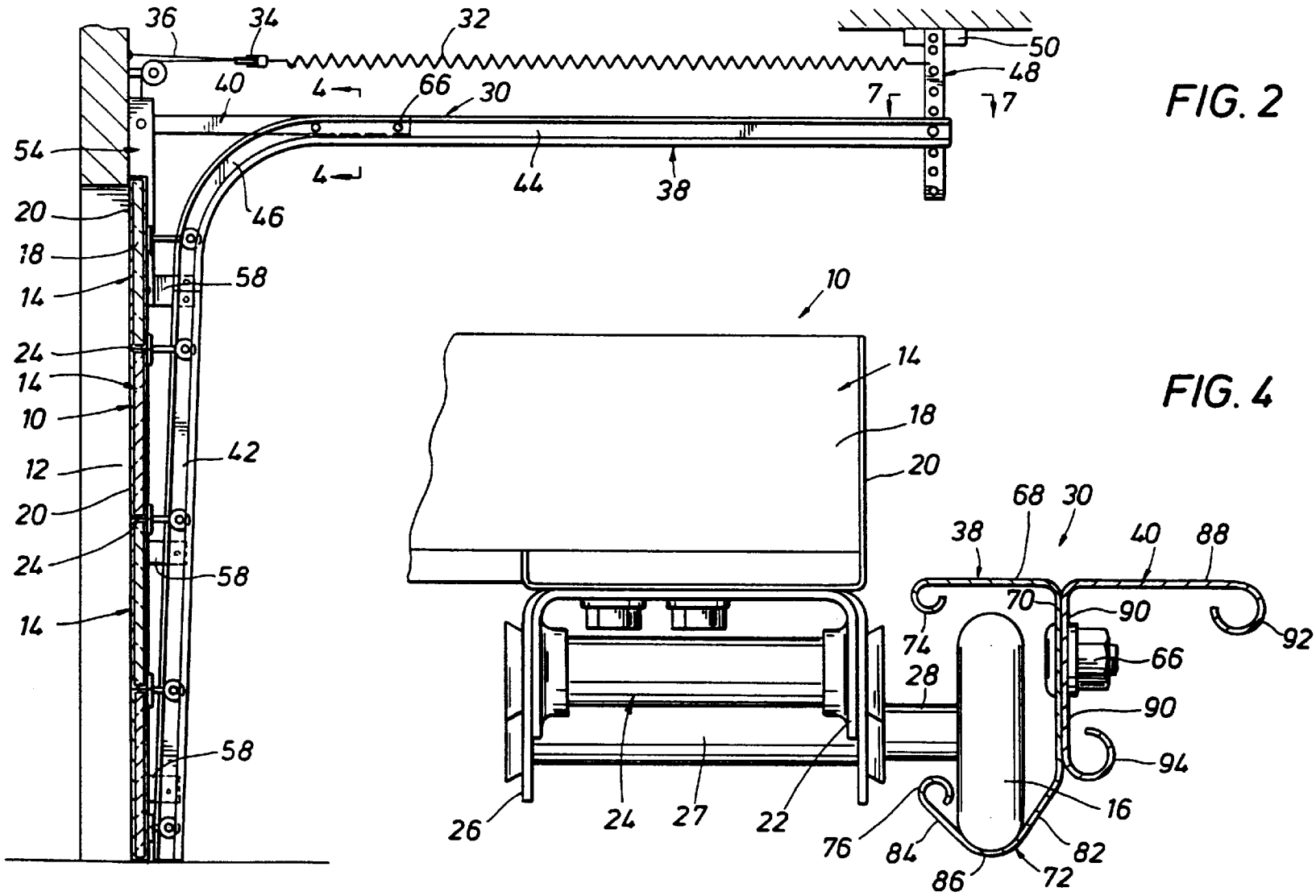
FIG. 2 is a section taken generally along line 2—2 of FIG. 1.
FIG. 4 is an enlarged cross sectional view of the upper horizontal track structure taken generally along line 4—4 of FIG. 2 but showing the hinged door in an open position with a door on a door panel mounted in the track for guiding and supporting the roller.

Referring now to the drawings for a better understanding of this invention, and more particularly to FIGS. 1–4, an overhead garage door is shown generally at 10 for fitting against a door jamb or frame 12 in closed position. Door 10 includes a plurality of hinged sections 14 having rollers 16 mounted thereon. Each hinged section 14 comprises an inner foam base 18 having an outer metal liner or sheath 20 thereon. A channel-shaped bracket 22 supports a hinge 24 between adjacent sections 14. A channel-shaped bracket 26 supports a sleeve 27 receiving a shaft 28 for roller 16. Suitable fasteners secure brackets 22 and 26 to door sections 14.

A track construction for supporting overhead door 10 for movement between open and closed position includes a light weight track structure generally indicated at 30 along each side of door 10 and comprising the present invention. Rollers 16 on opposed sides of door 10 are guided and supported in track structure 30 for movement of door 10 between the closed position as shown in FIGS. 1 and 2 and an open overhead position. A counterbalancing helical spring 32 anchored at the end is provided for each track structure 30 and has a pulley 34 at it other end. A suitable cable 36 is provided extending between pulley 34 and door 10 for assisting in the manual opening of door 10 as is well known. If desired, a suitable motor may be provided for opening and closing of door 10 as well known.

Referring now particularly to light weight track structure 30 which forms this invention, light weight track structure 30 comprises a light weight track generally indicated at 38 and a light weight angle-shaped track support member generally indicated at 40. Track 30 comprises a generally vertically extending section 42 and a generally horizontal section 44 which includes an integral intermediate arcuate portion 46 connecting horizontal section 44 and vertical section 42. It may be desirable to form arcuate portion 46 separately from horizontal section 44. The outer end of track 30 is secured to a perforated vertically extending angle-shaped hanger 48 secured at its upper end to a suitable joist 50. A fastener 52 extends within an opening or perforation in hanger 48 for securement of track 38 as shown particularly in FIG. 7.

Figure 3:
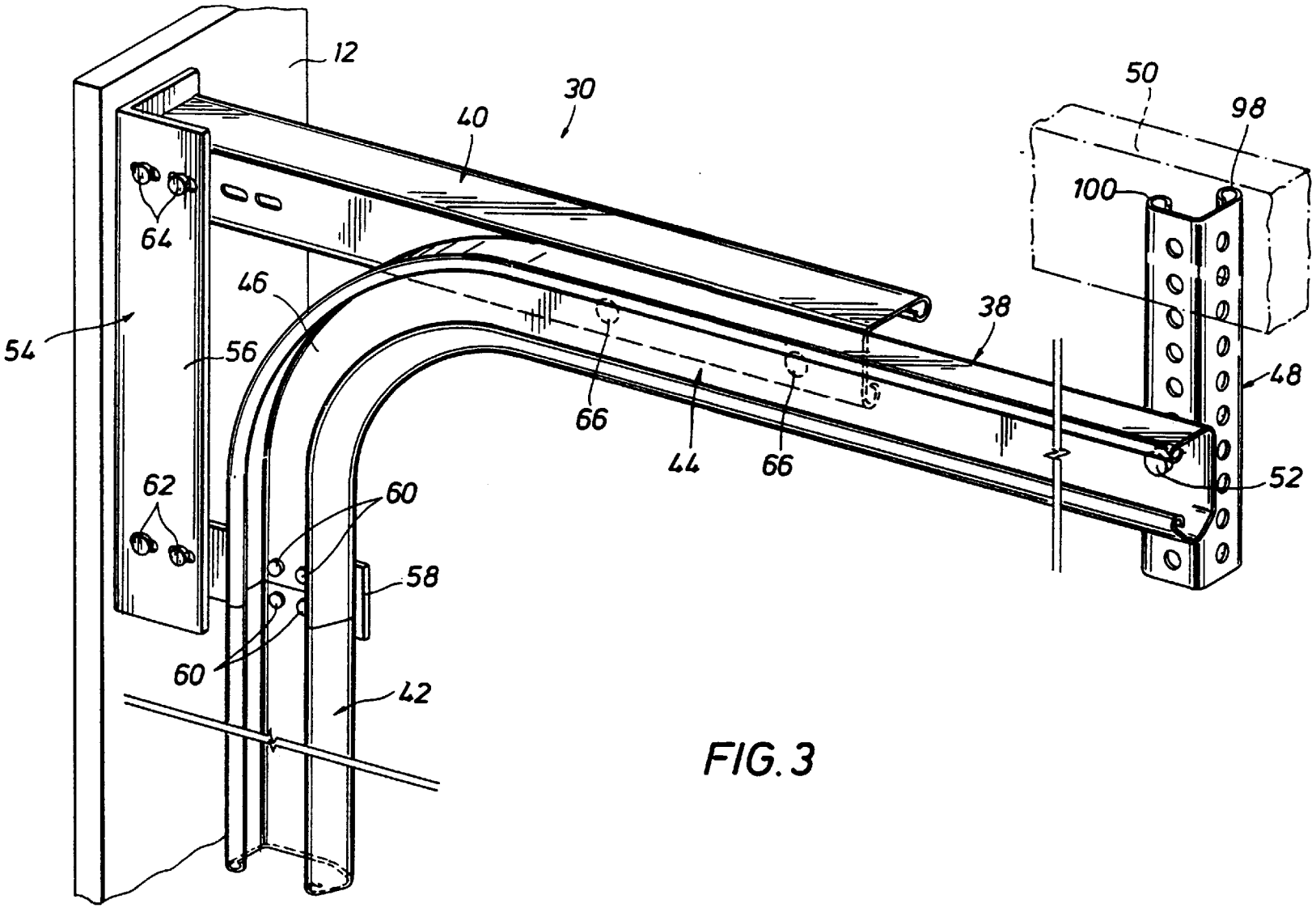
FIG. 3 is an enlarged perspective view of a portion of the track structure shown in FIG. 1 showing the track supported by a relatively short horizontal track support member.

Referring to FIG. 3, the mounting of horizontal track section 44 to doorjamb or frame 12 is illustrated. An angle-shaped support member 54 secured to door frame 12 has an extending leg 56 with openings therein. A lower mounting bracket or plate 58 is secured at one end by fasteners 60 to vertical track section 42 and to horizontal track section 44. Fasteners 62 secure the other end of plate 58 to leg 56. Fasteners 64 secure one end of track support member 40 to leg 56. Fasteners 66 secure the other extending end of track support member 40 to horizontal track section 44 as shown also in FIG. 4.

Track 38 and track support member 40 each has a pair of opposed free edge portions formed by inturned tubular beads or curls to provide strength so that only a small cross sectional area is required resulting in a lighter weight of metal material for track 38 and track support member 40. The tubular beads are formed of particular dimensions and shapes for providing the necessary strength while permitting a relatively small cross sectional area of sheet metal material to be utilized.

Referring now particularly to FIG. 5, track 38 commonly formed of a sheet metal material such as a steel alloy has an upper track flange 68, an integral side flange 70 at right angles to upper track flange 68, and a lower trough 72. The opposed free edge portions of upper flange 68 and trough 72 are inturned inwardly to form open-section tubular beads or edge curls 74 and 76. An open gap 78 is formed adjacent each tubular beads 74, 76. Tubular beads 74, 76 are shown as being of a circular configurations or shape in cross section and have an outer diameter indicated at d. Tubular beads 74, 76 are inturned inwardly an angular amount of about 270 degrees from the flange 68 and trough 72. Thus, gap 78 is of an angular amount about 90 degrees. If desired, tubular beads 74, 76 could be closed although 270 degrees has been found to be optimum. An angular or circular shape for beads 74, 76 as small as about 210 degrees would function in a satisfactory manner in most instances. While a circular shape for tubular beads 74 and 76 is preferred, a generally elliptical shape would function adequately in most instances. A tubular bead or curl of an elliptical shape has a major axis and a minor axis. Diameter or dimension d for an elliptical shape is interpreted herein for all purposes as the average dimension between the major axis and the minor axis. The major and minor axes are at right angles to each other and are defined as the major and minor dimensions of the open or closed tubular section. To provide an effective elliptical shape for tubular beads 74 and 76, the length of the minor axis should be at least about 45% of the length of the major axis. The terms "elliptical" shape and "elliptical" cross section are to be interpreted herein for all purposes as including circular shapes and circular cross sections.

Trough 72 has an inner wall 82 extending downwardly from side flange 70 and an outer wall 84 adjacent to tubular bead 76. An arcuate bottom 86 extends between walls 82 and 84 and has a radius of about ¼ inch to receive roller 16 in supporting relation as shown in FIG. 4.

In order for tubular beads 74, 76 to provide maximum strength with a minimal cross sectional area of track 38, the diameter d of tubular bead 76 is selected according to the width W1 of track 38 as shown in FIG. 5. A ratio of about 5 to 1 between W1 and d has been found to provide optimum results. A ratio of W1 to d of between about 3 to 1 and 8 to 1 would provide satisfactory results. A similar ratio between W2 and d for upper tubular bead 74 is utilized as an example of a relatively small track, W1 is 15/16 inch, W2 is 1 1/16 inch, and d is 3/16. Diameter d is at least 4 times the thickness of the metal for track 38.

The angle-shaped track support member 40 shown in FIG. 6 has a pair of flanges or legs 88 and 90. The free outer marginal portions of flanges 88 and 90 are turned inwardly to form tubular beads or curls 92, 94 which are of a similar size and shape. Beads 92, 94 are of a circular shape and extend in an angular relation A for about 270 degrees from the respective legs 88 and 90 a gap 96 is provided adjacent each bead 92, 94. Beads 92 and 94 may be closed, if desired, but a closed bead would not normally provide the most effective design. However, a minimum angular contour of 210 degrees is needed to obtain satisfactory results. Legs 88 and 90 are of a similar shape and size having a width W3. Width W3 is preferably about 3 times the outer diameter d1 of tubular beads 92, 94. A width W3 between about 2 times and 7 times the outer diameter d1 of tubular beads 92, 94 will function in a satisfactory manner. Beads 92, 94 may also be of an elliptical shape and function effectively with the minor axis being at least about 45% of the major axis.

Hanger 48 shown in FIGS. 2 and 7 has tubular beads or curls 98, 100 and is similar in cross section to track support member 40 as shown in FIG. 6 except having perforations to receive fasteners for securing track 38.

In order to obtain the desired minimal weight track construction, tubular curls 74, 76 on track 38 and tubular curls 92, 94 on track support member 40 must be shaped and formed within precise ranges and sizes in order to provide maximum strength. Using various design formulae to determine the outer diameters of tubular curls 74, 76 for track 38, an optimum outer diameter of 3/16 inch was found to be satisfactory. Diameter d is relatively small due to the shape of the trough 72 and the need to provide clearance to receive roller 16 in trough 72. The optimum outer diameters d1 of tubular curls 92, 94 for track support member 40 utilizing various design formulae was ⅜ inch or twice the diameter d of track curls 74, 76. In order to obtain satisfactory results for a light weight track construction diameter d1 for tubular curls 92, 94 for track support member 40, d1 is between about 1½ and 2½ times diameter d for tubular curls 74, 76 of track 38. By providing such a relationship between tubular curls 74, 76 and tubular curls 92, 94 the moment of inertia is maximized and edge stress concentrations are minimized for track 38 and track support member 40 which are of different shapes thereby permitting the light weight construction for the door support track structure of the present invention. Tubular curls 74, 76 and 92, 94 are illustrated as turned inwardly which is the most desirable. In some instances it may be desirable to have a tubular curl turned outwardly such as upper curl 92 on track support member 40 or upper curl 74 on track 38. Hanger 48 has substantially the same cross sectional area as track support member 40 and tubular curls 98, 100 are similar to curls 92, 94 on support member 40.

Overhead garage doors generally range between a 9 foot width for single cars and an 18 foot width for two cars. A typical 9 foot door weighs approximately 120 pounds and an 18 foot door weighs approximately 350 pounds when utilizing a door comprising foam filled sectional panels having a steel skin or sheath. These door installations generally use approximately 2-inch deep track made of galvanized steel. Commercial doors, which are much heavier, may incorporate 3-inch deep track. A typical 120-lbs. single car overhead door is 7 feet high and composed of four 21-inch high door panels, each of which is 9 feet wide. The track structure 30 on which the door rides as it opens and closes includes the following four components to which the present invention applies; the vertical track section 42, the horizontal track section 44, the horizontal angle support member 40, and the perforated angle member hanger 48.

The dimensions of each of these components for a door having a weight of 120 lbs. are as follows. The vertical track section 42 is 76 inches long, the horizontal track section is 102.5 inches long including the curved portion 46 and the horizontal angle member is 30 inches long. The length of the perforated angle member hanger 48 varies based on the particular installation's ceiling height, and may include additional perforated hangers attached to the vertical track section 42 for purposes of bracing. Typical minimum thickness and galvanized sheet steel gauges used for the parts are: 0.034 inch min. or 21 gauge for horizontal track section 44, the horizontal angle member 40, and the perforated angle member hanger 48. A 0.022 inch min. or 25 gauge galvanized sheet metal is used for the vertical track section 42.

The sectional dimensions are typically the same for the vertical and horizontal track sections 42, 44. The width of the top flange 68 is 1 1/16 inch. The outer diameter of top flange curl 74 is 3/16 inch. The depth of the track is 2 1/8 inch. The width of the trough 72 is 15/16 inch and the height of the trough 72 is 7/16 inch. The outer diameter of the trough curl is 3/16 inch. Both the trough and top flange curls must be 210 degrees minimum but can range up to 360 degrees.

For a typical 350 lbs. double car overhead door, the dimensions noted above would still apply with the following modifications. Horizontal angle member 40 is increased in length to 82 inches from 30 inches. Horizontal track section 44 is increased in thickness to 0.038 inch minimum or 20 gauge from 0.034 inch minimum. Vertical section 42 is increased in thickness to 0.038 inch minimum or 20 gauge from 0.022 inch minimum.

As a result of providing the inturned tubular beads or curls along the marginal edge portions of selected members of the track support or operating structure, an unexpectedly significantly thinner gauge material at least about twenty five percent lighter has been utilized for the track support or operating structure including the track, track support member and hanger as compared with prior art track support structure as utilized heretofore. By utilizing precise tubular beads as set forth herein on the selected members where it is most needed for strength, a manufacturer may utilize an unexpectedly substantially thinner gauge material while eliminating or minimizing problems encountered heretofore by prior art designs for track support structures for overhead sectional doors, such as used in garages and vehicles.

Figure 8:
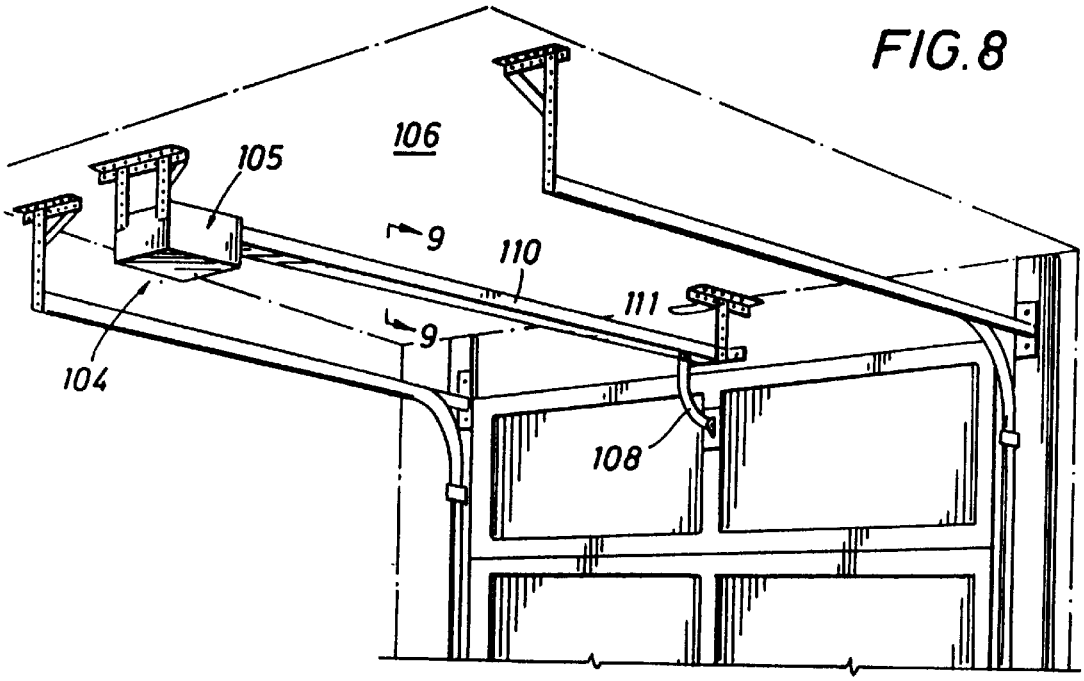
FIG. 8 is a perspective view of a sectional overhead door showing an operator for movement of the door between open and closed positions.
Figure 9:
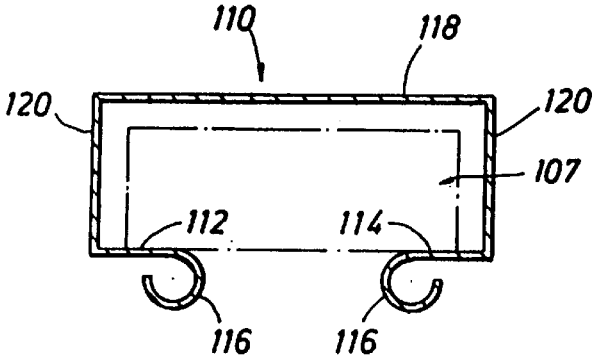
FIG. 9 is an enlarged cross sectional view of a support member for supporting a chain or belt drive of the operator for effecting movement of the door.
Figure 10:
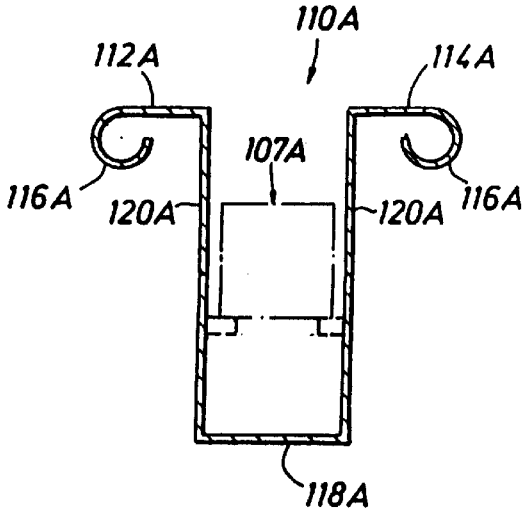
FIG. 10 is an enlarged cross sectional view of a modified support member for supporting a chain or belt drive of the operator.

Embodiment of FIGS. 8–10

Referring now to FIGS. 8–10, an automatic door operator is shown generally at 104 for raising and lowering the sectional overhead garage door 10 as shown in FIGS. 1–7. As well known, an electric motor shown at 105 supported from garage ceiling 106 by support brackets is connected in driving relation to an endless member, such as a chain or belt, mounted about pulleys or sprocket and driven by motor 105. The endless member is attached to opposed ends of a trolley or carrier 107 for back and forth movement of carrier 107 within a support bar or beam 110. Beam 110 is supported at one end by brackets 111. Carrier 107 is connected to a link 108 pivotally connected to the upper section of door 10 for movement of the door between open and closed position. Support beam 110 has a pair of flanges 112 and 114 on its lower end and tubular curls or beads 116 on the free edges of flanges 112, 114. Carrier 107 is supported on flanges 112, 114. Support beam 110 includes an upper cover or side 118 and a pair of downwardly extending opposed sides 120 having flanges 112 and 114 thereon. Tubular beads 112 and 114 are similar in shape to beads 92 and 94 shown in FIG. 6.

FIG. 10 shows a modified support bar or beam 110A having a bottom wall or side 118A and opposed parallel sides 120A having upper flanges 112A and 114A. Tubular beads 116A are provided on the free edges of flanges 112A and 114A. Tubular beads 116A are similar to beads 116 in the embodiment of FIG. 9. The embodiment of FIG. 10 has a carrier 107A mounted on guides within beam 110A and is particularly adapted for use with chain type drives for the opening and closing of door 10. In some instances a worm gear drive could be utilized for movement of the carrier. In other instances, the chain type drives could run outside instead of inside the beam 110A on either side of parallel sides 120A.

As a result of tubular beads 116 on bar 110 and tubular beads 116A on bar 110A the amount of metal in bars 110 and 110A has been substantially reduced from that utilized by the prior art. For example, the thickness of the metal for the embodiment of FIG. 9 has been decreased from a thickness of 0.086 inch to a thickness of 0.051 inch. The thickness of metal for the embodiment of FIG. 10 has been decreased from a thickness of 0.086 inch to a thickness of 0.038 inch.

While the particular invention as herein shown and disclosed in detail is fully capable of obtaining the objects and providing the advantages hereinbefore stated, it is understood that this disclosure is merely illustrative of the presently preferred embodiments of the invention and that no limitations are intended other than as described in the appended claims.

What is claimed is:

1. A track support structure for a sectional overhead door having rollers for guiding the door between open and closed positions; said track support structure comprising:

a track constructed for supporting the rollers and door in an open position, said track defining in cross section an upper horizontal flange, a vertical side flange integral with said horizontal flange, and a lower trough integral with said vertical flange, said trough and said horizontal flange each having a free edge;

a track support member secured to said vertical side flange of said track for supporting said track; and a tubular bead extending along the free edge of each of said horizontal flange and said trough, said tubular beads being of an elliptical cross section wherein the minor axis is at least about 45 percent of the major axis.

2. A track support structure as defined in claim 1 wherein said track support member is angle-shaped including a horizontal leg and a vertical leg, said vertical leg of said track support member being secured to said vertical side flange of said track; and a tubular bead extends along the free edge of each of said legs of said track support member, said tubular beads of said track support member being of an elliptical cross section wherein the minor axis is at least about 45 percent of the major axis.

3. A track support structure as defined in claim 1 wherein said tubular beads on said trough and said horizontal flange of said track are turned inwardly of respective said trough and horizontal flange.

4. A track support structure as defined in claim 2 wherein said tubular beads on said legs of said track support member are turned inwardly of respective said legs.

5. A track support structure for a sectional overhead door having rollers for guiding the door between open and closed positions; said track support structure comprising:

a track having a vertical track section constructed for positioning adjacent a side of said door, a horizontal track section, and a curved intermediate portion connecting said horizontal track section to said vertical track section, said track sections defining an upper horizontal flange and a lower trough each having a free edge;

a tubular bead along the free edge of said trough and along the free edge of said horizontal flange;

an angle-shaped track support member secured to said horizontal section of said track defining a horizontal leg and a vertical leg, said vertical leg being secured to said track; and a tubular bead along the free edge of said legs of said track support member, said tubular beads of said track support member being of an elliptical cross section wherein the minor axis is at least about 45 percent of the major axis.

6. A track support structure as defined in claim 5 wherein said track further comprises a vertical side flange integral with said horizontal flange and said lower trough; and said vertical leg of said angle-shaped track support member is secured to said vertical side flange of said track in face-to-face contact relation.

7. A track support structure as defined in claim 6 wherein said tubular beads on said legs of said track support member are turned inwardly of said legs.

8. In an overhead garage door arrangement including a horizontally hinged sectional door movable between open and closed positions and having rollers thereon; a track construction for guiding said rollers and supporting said door comprising:

a pair of generally parallel track support structures adjacent a door frame along opposed sides of said door and supporting said rollers for guided movement between said open and closed positions of said door; each track support structure having a track for said rollers;

said track having a vertical track section adjacent a side of said door, and a horizontal track section for supporting the rollers and door in an open position including a curved intermediate portion connecting said horizontal track section to said vertical track section; said track sections defining in cross section an upper horizontal flange, a vertical flange integral with said horizontal flange, and a lower trough integral with said vertical flange to receive the rollers;

a horizontally extending angle-shaped track support member extending horizontally from said door frame to said track including a horizontal leg and a vertical leg, said vertical leg being secured in face-to-face contact with said vertical flange of said track; and a tubular bead extending along the free edge of each of said legs, said tubular beads of said track support member being of an elliptical cross section wherein the minor axis is at least about 45 percent of the major axis.

9. In an overhead garage door structure as defined in claim 8 wherein said tubular beads are inturned inwardly of the respective legs, and said horizontal leg of said track support member is generally in a horizontal plane with said upper horizontal flange of said track.

10. In an overhead garage door arrangement as defined in claim 8 further comprising:

a vertically extending support member secured to said door frame adjacent said curved intermediate portion;

said horizontally extending support member and said curved intermediate portion being secured to said vertically extending support member.

11. In an overhead garage door arrangement as defined in claim 10 wherein said vertically extending support member comprise an angle having a pair of legs, one of said legs extending outwardly from said door frame and being secured to said curved intermediate portion and said horizontally extending track support member.

12. In an overhead garage door arrangement as defined in claim 8 further comprising:

a vertically extending hanger supporting of said horizontal track section, said hanger support comprising an angle including a pair of legs; and a tubular bead along the free edge of each leg of said hanger, said tubular beads being of an elliptical cross section wherein the minor axis is at least about 45 percent of the major axis.

* * * * *